US008220967B2

(12) United States Patent
Lai

(10) Patent No.: US 8,220,967 B2
(45) Date of Patent: Jul. 17, 2012

(54) EMBEDDED SLIDING ASSEMBLY AND POSITIONING STRUCTURE OF A LAMP REFLECTOR

(75) Inventor: Ming-Hsiao Lai, Chang-Hua Hsien (TW)

(73) Assignee: Shenter Enterprise Co., Ltd., Chang-Hua Hsien (TW)

( * ) Notice: Subject to any disclaimer, the term of this patent is extended or adjusted under 35 U.S.C. 154(b) by 0 days.

(21) Appl. No.: 13/113,577

(22) Filed: May 23, 2011

(65) Prior Publication Data

US 2011/0286220 A1 Nov. 24, 2011

(30) Foreign Application Priority Data

May 21, 2010 (TW) ..... 99209550 U

(51) Int. Cl.
*F21V 19/02* (2006.01)

(52) U.S. Cl. ..... 362/285; 362/375

(58) Field of Classification Search ..... None
See application file for complete search history.

(56) References Cited

U.S. PATENT DOCUMENTS 3,071,683 A * 1/1963 Queale ..... 362/295
3,184,199 A * 5/1965 Clark et al. ..... 362/431
3,297,864 A * 1/1967 Waldbauer ..... 362/310
3,387,866 A * 6/1968 Baldwin ..... 285/184
4,255,781 A * 3/1981 Plemmons et al. ..... 362/374
4,360,863 A * 11/1982 Barnes et al. ..... 362/346
4,379,321 A * 4/1983 Plemmons et al. ..... 362/267
4,426,676 A * 1/1984 Taylor ..... 362/371
4,538,217 A * 8/1985 Ewing et al. ..... 362/375
4,551,793 A * 11/1985 Mellema ..... 362/370
4,635,172 A * 1/1987 Steinke ..... 362/276
4,639,843 A * 1/1987 Compton ..... 362/431
4,793,581 A * 12/1988 Bilson et al. ..... 362/431
4,937,718 A * 6/1990 Murray ..... 362/431
4,947,297 A * 8/1990 Druffel et al. ..... 362/147
5,136,493 A * 8/1992 Straus et al. ..... 362/373
5,655,833 A * 8/1997 Raczynski ..... 362/419

* cited by examiner

*Primary Examiner* — Hargobind S Sawhney
(74) *Attorney, Agent, or Firm* — Egbert Law Offices PLLC

(57) ABSTRACT

An embedded sliding assembly and positioning structure of a lamp reflector which allows a reflector to be assembled fixedly onto a lamp. The embedded sliding assembly and positioning structure have a positioning framework having a reflector assembly side, an end side and two lateral sides. A through-hole is formed at the center of the positioning framework, and the positioning framework is also provided with an assembly and positioning portion for assembly onto the lamp. An embedded sliding guide is set at an inner edge of the end side and two lateral sides of the positioning framework. The embedded sliding guide is set in a manner to guide the sliding and locking of the flange of the reflector. A positioner enables tight locking of the flange of the reflector to the embedded sliding guide.

6 Claims, 8 Drawing Sheets

EMBEDDED SLIDING ASSEMBLY AND POSITIONING STRUCTURE OF A LAMP REFLECTOR

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates generally to an assembly and positioning structure of a lamp reflector, and more particularly to an innovative one which is designed into an embedded sliding one for assembly and positioning.

2. Description of Related Art Including Information Disclosed Under 37 CFR 1.97 and 37 CFR 1.98.

The reflector is a crucial part of lamp structure, since most of the rays emitted from its luminous body are reflected by the said reflector to realize the intended diffusion gain effect.

Made of an independent structure, the reflector is generally prefabricated and then assembled onto a preset location of the lamp structure. The present invention intends to improve the said reflector's assembly and positioning structure.

Generally, the assembly and positioning structure of the existing reflector is implemented by means of bolting. Yet, owing to bigger area and weight of the reflector, multiple bolts must be arranged at interval. Particularly, at least two bolts are assembled at either side of the rectangular reflector for the desired robustness. However, this will result in time-consuming assembly, poorer efficiency and higher manufacturing cost. Moreover, inconvenient disassembly may occur when removing the reflector.

From another perspective, if the reflector is to be positioned directly onto the lamp via bolts, some punch holes must be drilled onto the reflector itself. There is not any difficulty in processing of a metal reflector. If some holes must be drilled onto a glass reflector, the processing cost becomes very high, and the glass is vulnerable to breakage or fracture owing to bolting. Hence, an important technical concern is how to improve the assembly and positioning pattern of the reflector.

Thus, to overcome the aforementioned problems of the prior art, it would be an advancement if the art to provide an improved structure that can significantly improve the efficacy.

Therefore, the inventor has provided the present invention of practicability after deliberate design and evaluation based on years of experience in the production, development and design of related products.

BRIEF SUMMARY OF THE INVENTION

The enhanced efficacy of the present invention is as follows:

Based on the unique construction of the present invention wherein the "embedded sliding assembly and positioning structure of the lamp reflector" mainly comprises a positioning framework, embedded sliding guide and positioner, the lamp reflector of stronger robustness can be assembled and removed more conveniently and efficiently, without adding bolt holes. So, it can be adapted to the reflectors made of special materials (e.g.: glass) with improved applicability and industrial benefits.

Although the invention has been explained in relation to its preferred embodiment, it is to be understood that many other possible modifications and variations can be made without departing from the spirit and scope of the invention as hereinafter claimed.

DETAILED DESCRIPTION OF THE INVENTION

Figure 1:
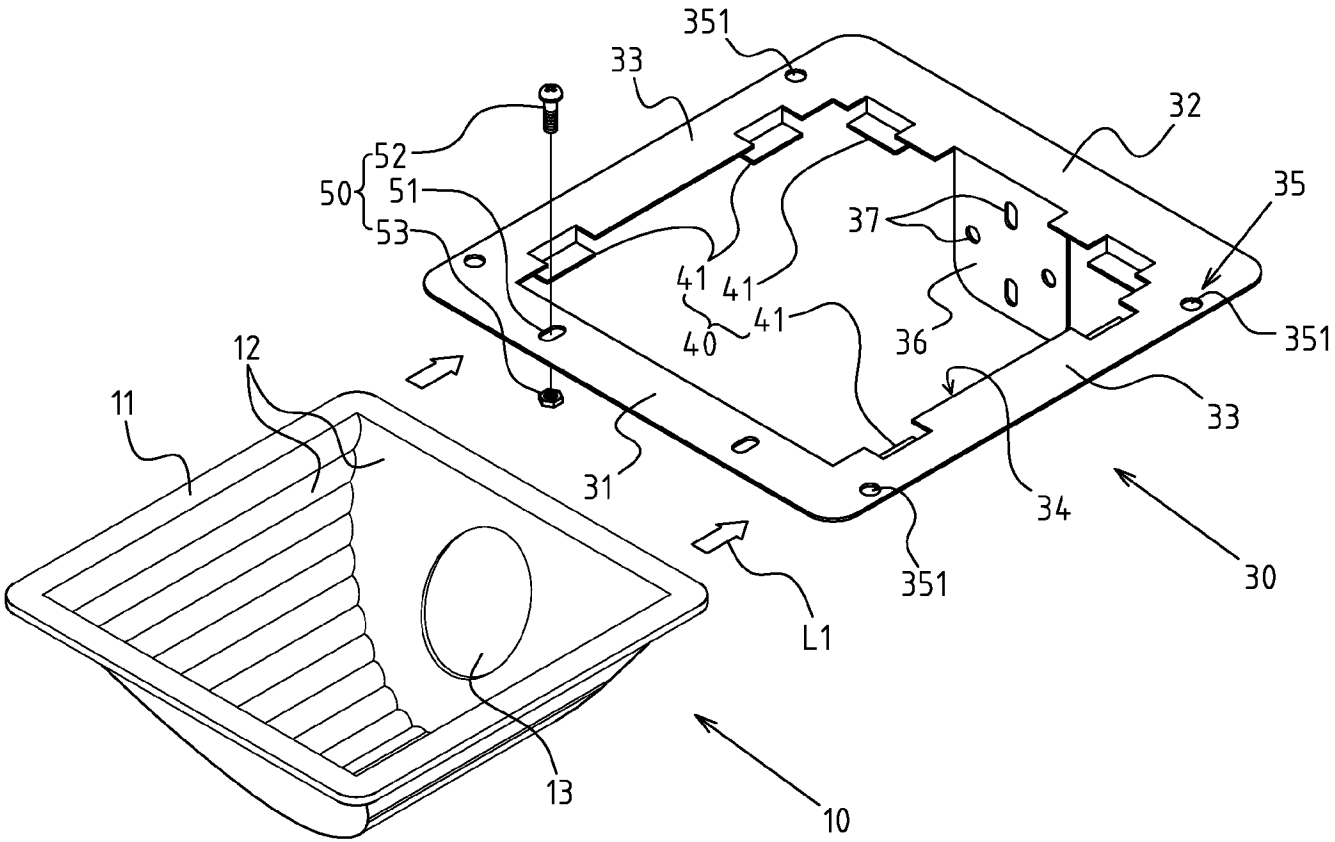
FIG. 1 is an exploded 3D perspective view of the present invention showing the reflector and positioning framework.

FIG. 1 depicts a preferred embodiment of an embedded sliding assembly and positioning structure of lamp reflector the present invention, which, however, is provided for only explanatory objective for patent claims. The said embedded sliding assembly and positioning structure allows a reflector 10 to be assembled fixedly onto a lamp 20 (shown in FIGS. 8, 9). Of which, the reflector 10 comprises a flange 11 (a rectangular flange in this preferred embodiment), a reflecting surface 12 and the luminous body's punch hole 13. The said reflecting surface 12 is available with many patterns, e.g.: the reflecting surface 12 of this preferred embodiment is composed of an arched surface and two oblique extended surfaces.

The embedded sliding assembly and positioning structure comprises a positioning framework 30, made of a metal framework (a rectangular one in this preferred embodiment), having a reflector assembly side 31, an end side 32 and two lateral sides 33. A through hole 34 is formed at the center of the positioning framework 30. The positioning framework 30 is also provided with an assembly and positioning portion 35 for assembly onto the lamp 20.

An embedded sliding guide 40 is set at inner edge of the end side 32 and two lateral sides 33 of the positioning framework 30. The embedded sliding guide 40 shall be set in a manner to guide the sliding and locking of the flange 11 of the reflector 10.

At least one positioner 50 enables one to lock tightly the flange 11 of the reflector 10 to the embedded sliding guide 40.

Of which, a corrugated extension plate 36 is formed at inner edge of the end side 32 of the positioning framework 30. The corrugated extension plate 36 is positioned correspondingly to the luminous body's punch hole 13 of the reflector 10, and also provided with a luminous body's positioning portion 37. The said luminous body's positioning portion 37 is available with a plurality of through-holes, allowing one to assemble and position a luminous body 60 (shown in FIG. 4). The said luminous body 60 is a halogen lamp.

Referring to FIG. 1, the assembly and positioning portion 35 of the positioning framework 30 comprises a plurality of bolt holes 351 on two lateral sides 33.

Figure 3:
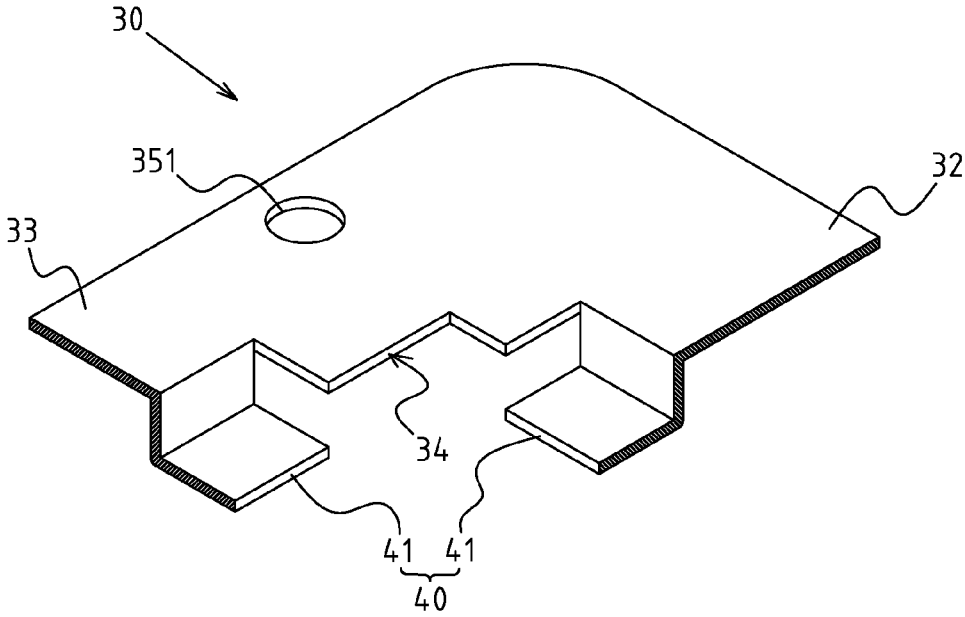
FIG. 3 is a 3D sectional view of the present invention showing the embedded sliding guide of the positioning framework.

Referring to FIG. 3, the embedded sliding guide 40 comprises a plurality of L-shaped curved sheets 41 set at interval onto inner edge of the end side 32 and two lateral sides 33 of the positioning framework 30.

Figure 5:
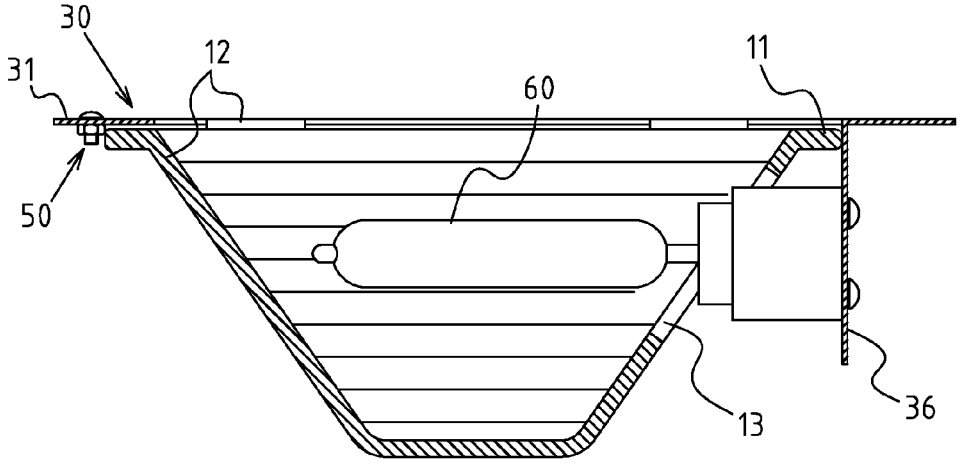
FIG. 5 is an assembled plain view of the present invention showing the reflector and positioning framework.
Figure 6:
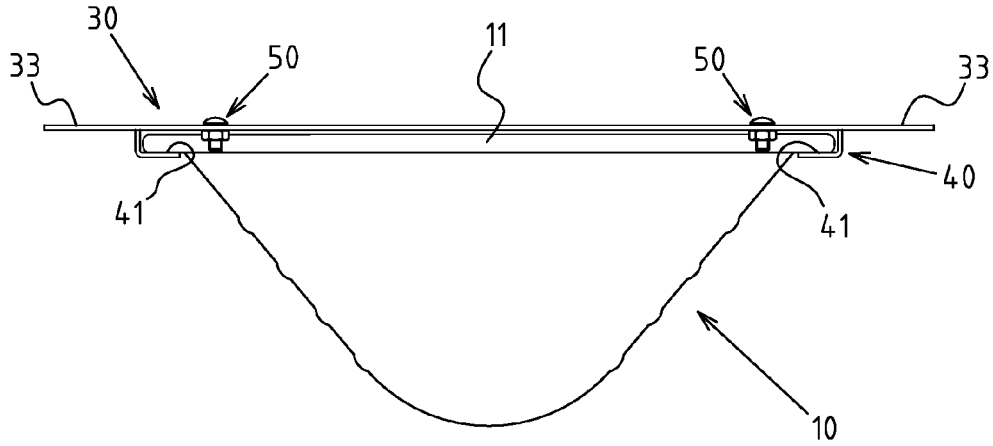
FIG. 6 is an assembled lateral view of the present invention showing the reflector and positioning framework.
Figure 7:
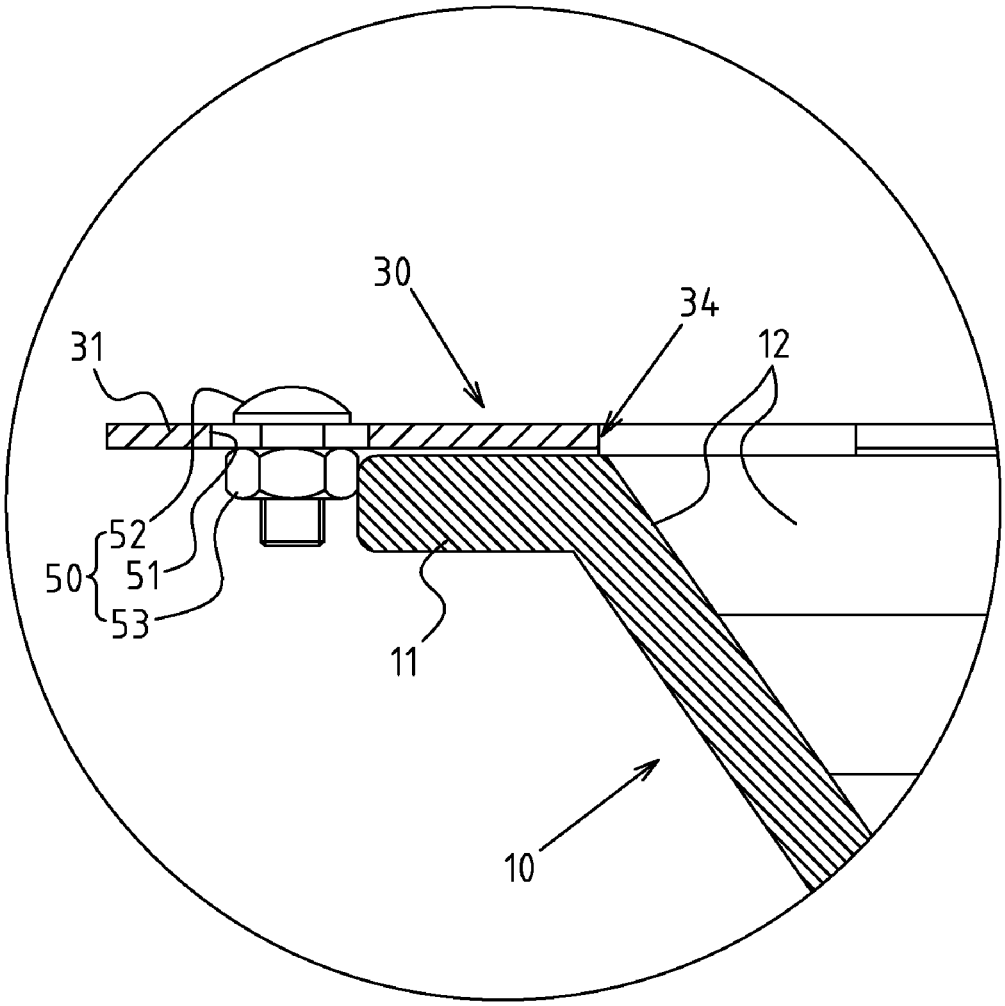
FIG. 7 is a sectional view of a preferred embodiment of the positioner of the present invention.

Referring to FIGS. 1 and 7, the positioner 50 comprises at least a through-hole 51 set on the reflector assembly side 31 of the positioning framework 30, a bolt 52 onto the through-hole 51 and a nut 53 screwed onto the bolt 52. With the construction of this positioner 50, when the flange 11 of the reflector 10 is locked into the embedded sliding guide 40 (shown in FIG. 5), the reflector 10 can be assembled securely by abutting onto the flange 11 via the nut 53.

Figure 2:
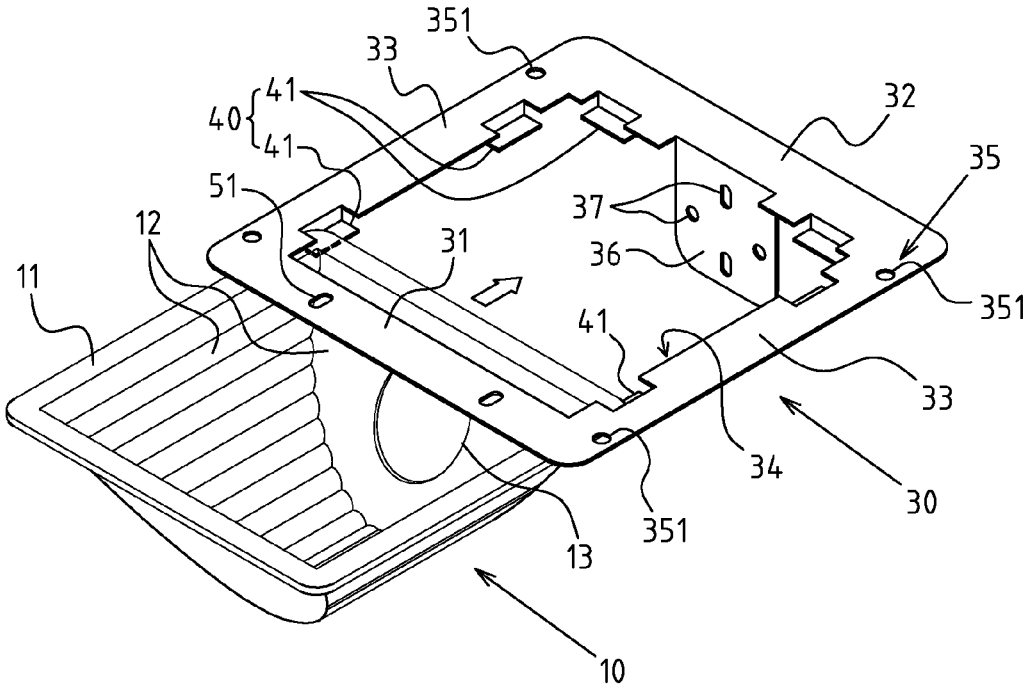
FIG. 2 is a schematic view of the present invention wherein the reflector is assembled into the positioning framework.
Figure 4:
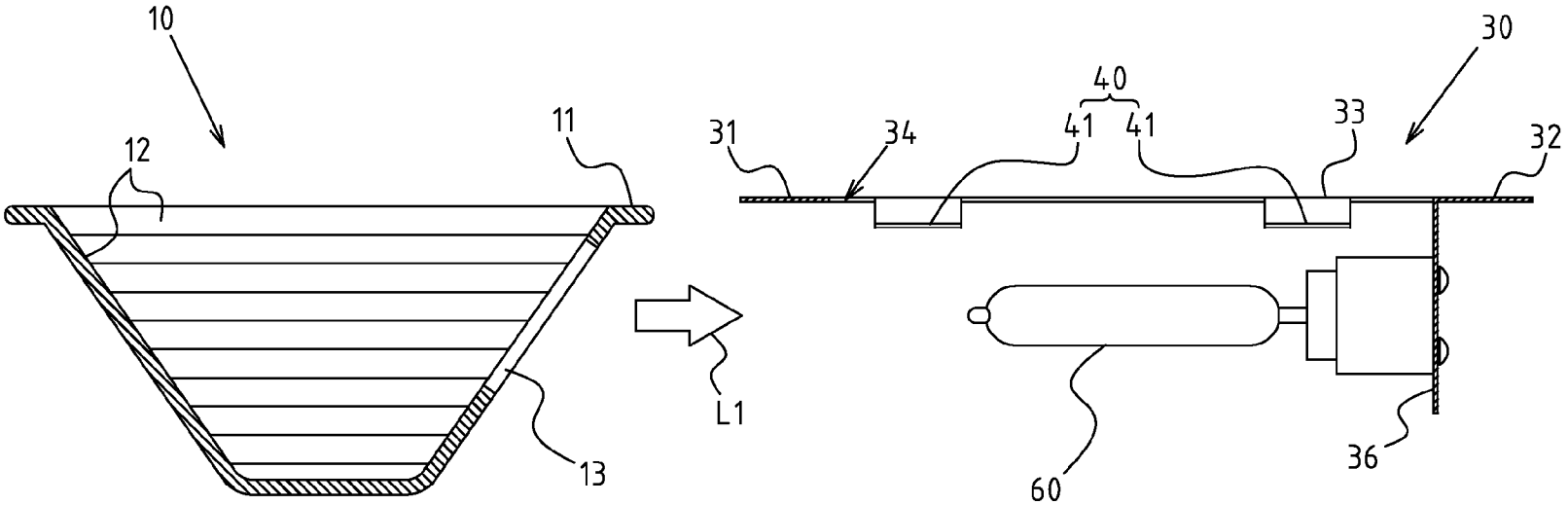
FIG. 4 is an exploded plan view of the present invention showing the reflector and positioning framework.

Based on above-specified structure, the present invention is operated and assembled as follows:

The core aspect of the present invention lies in that, the positioning framework 30 is provided with the embedded sliding guide 40. Referring to FIGS. 1, 2 and 4, when it's intended for assembly of the reflector 10, the flange 11 of the reflector 10 is assembled firstly into the reflector assembly side 31 of the positioning framework 30 (marked by arrow L1 in FIGS. 1, 4). Next, both sides of the flange 11 pass through the embedded sliding guide 40 (shown in FIG. 2) at inner edge of two lateral sides 33 of the positioning framework 30, and are finally abutted into the embedded sliding guide 40 (shown in FIG. 5) set at the end side 32 of the positioning framework 30, thereby finishing the slidable insertion of the reflector 10. Referring also to FIG. 7, the reflector 10 and positioning framework 30 are assembled securely by abutting the flange 11 of the reflector through the positioner 50.

Figure 8:
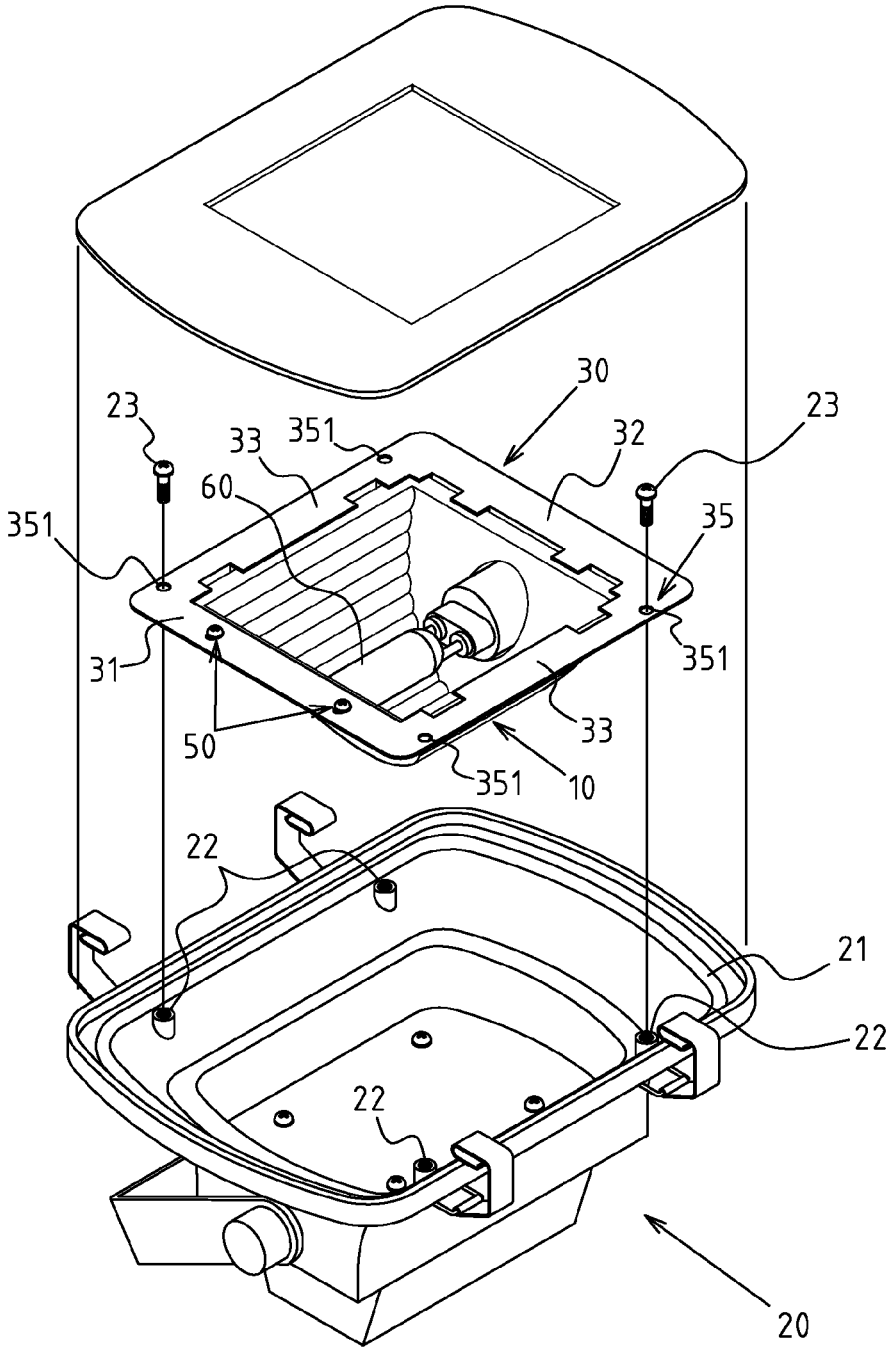
FIG. 8 is an exploded 3D view of the present invention showing the assembly relationship of the reflector, positioning framework and lamp.
Figure 9:
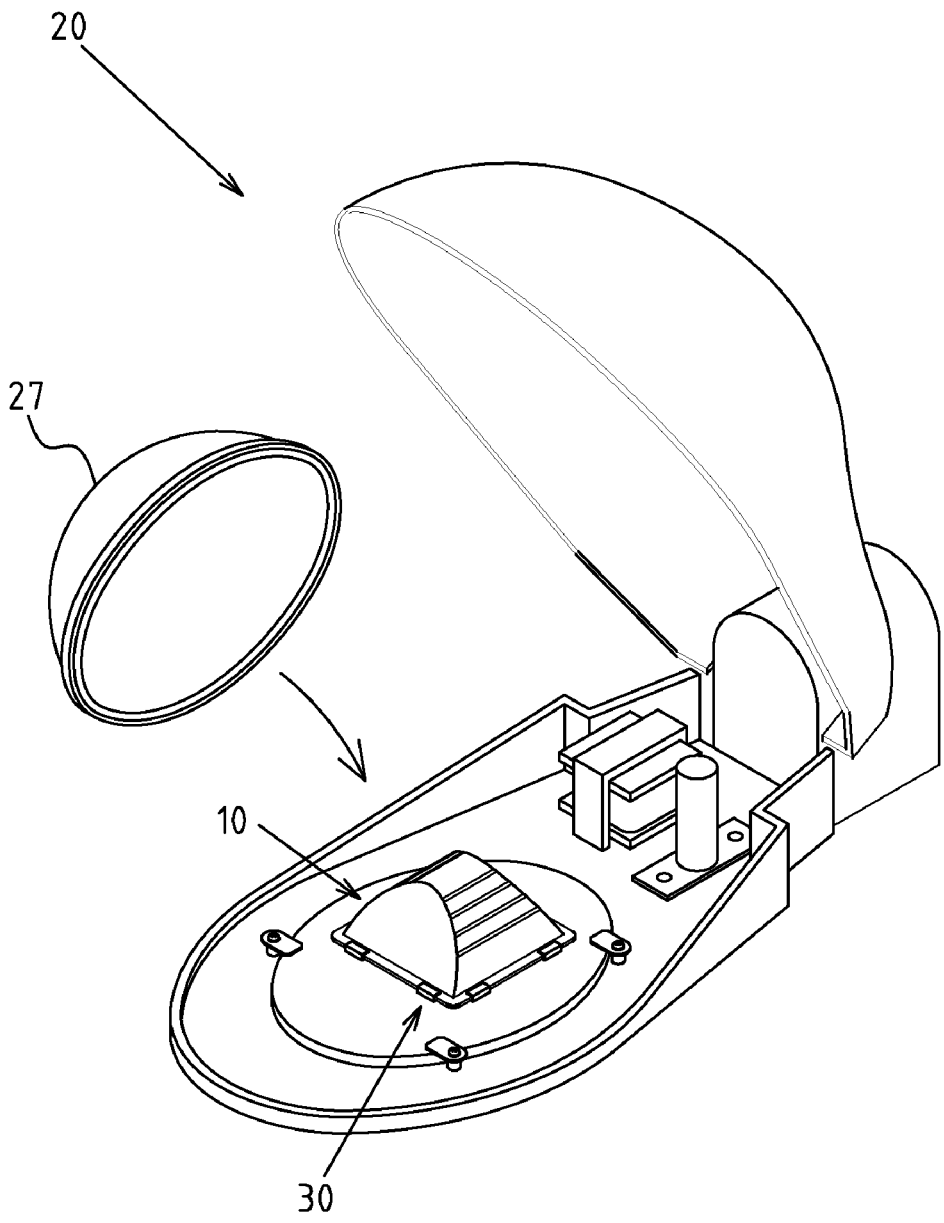
FIG. 9 is an exploded 3D view of the present invention showing the assembly relationship of the reflector, positioning framework and another lamp.

Referring to FIG. 8, when the said lamp 20 is used as a search lamp, the positioning framework 30 and the lamp 20 are assembled in such a manner that, some locating screw holes 22 are preset into the groove 21 of the lamp 20. When the positioning framework 30 is assembled into the groove 21 of the lamp 20, the bolt holes 351 of the assembly and positioning portion 35 are aligned with the locating screw holes 22 of the groove 21, and then located securely by the bolt 23. Referring also to FIG. 9, when the lamp 20 is used as a road lamp, the positioning framework 30 can be covered by a waterproofing cover 27.

Figure 10:
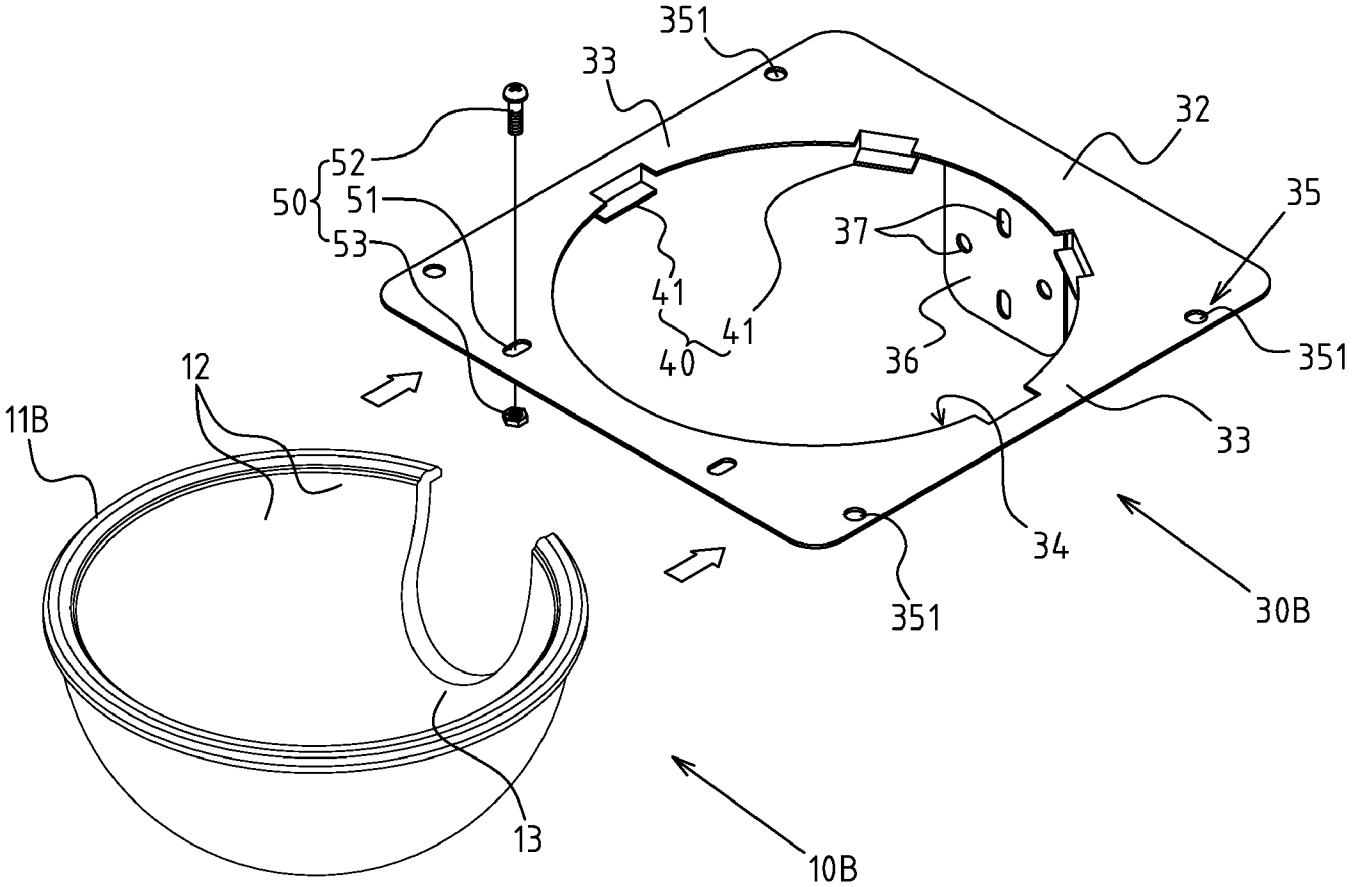
FIG. 10 is a schematic view of the present invention wherein the flange and the positioning framework are incorporated into a round pattern.

Referring also to FIG. 10, the flange 11B of the said reflector 10 and the positioning framework 30B are incorporated into a round pattern, indicating that the reflector flange and positioning framework of the embedded sliding assembly and positioning structure include but not limited to either of rectangular, round, square or polygonal patterns.

I claim:

1. An embedded sliding assembly and positioning structure of a lamp reflector, which allows a reflector to be assembled fixedly onto a lamp; of which the reflector has a flange, a reflecting surface and luminous body's punch hole; the embedded sliding assembly and positioning structure comprising:

a positioning framework, having a reflector assembly side, an end side and two lateral sides; a through hole is formed at the center of the positioning framework; the positioning framework is also provided with an assembly and positioning portion for assembly onto the lamp;

an embedded sliding guide, set at inner edge of the end side and two lateral sides of the positioning framework; the embedded sliding guide is set in a manner to guide the sliding and locking of the flange of the reflector;

at least a positioner, enabling to lock tightly the flange of the reflector to the embedded sliding guide.

2. The structure defined in claim 1, wherein a corrugated extension plate is formed at an inner edge of the end side of the positioning framework; the corrugated extension plate is positioned correspondingly to the luminous body's punch hole of the reflector, and also provided with a luminous body's positioning portion.

3. The structure defined in claim 1, wherein the assembly and positioning portion of the positioning framework comprises a plurality of bolt holes on two lateral sides.

4. The structure defined in claim 1, wherein the embedded sliding guide comprises a plurality of L-shaped curved sheets set at interval onto inner edge of the end side and two lateral sides of the positioning framework.

5. The structure defined in claim 1, wherein the positioner consists of comprises at least a through-hole set on the reflector assembly side of the positioning framework, a bolt onto the through-hole and a nut screwed onto the bolt; when the flange of the reflector is locked into the embedded sliding guide, the reflector can be assembled securely by abutting onto the flange via the nut.

6. The structure defined in claim 1, wherein the reflector flange and positioning framework include but not limited to either of rectangular, round, square or polygonal patterns.

* * * * *